US011975888B2

(12) United States Patent
Meiring

(10) Patent No.: US 11,975,888 B2
(45) Date of Patent: May 7, 2024

(54) HOUSING UNIT FOR A LOAD CARRIER

(71) Applicant: Peter Alexander Meiring, Simondium (ZA)

(72) Inventor: Peter Alexander Meiring, Simondium (ZA)

( * ) Notice: Subject to any disclaimer, the term of this patent is extended or adjusted under 35 U.S.C. 154(b) by 495 days.

(21) Appl. No.: 17/271,681

(22) PCT Filed: Aug. 28, 2019

(86) PCT No.: PCT/IB2019/057255

§ 371 (c)(1),
(2) Date: Feb. 26, 2021

(87) PCT Pub. No.: WO2020/044263

PCT Pub. Date: Mar. 5, 2020

(65) Prior Publication Data

US 2021/0188482 A1 Jun. 24, 2021

(30) Foreign Application Priority Data

Aug. 28, 2018 (ZA) ..... 2018/05723

(51) Int. Cl.
*B65D 19/38* (2006.01)
*B65D 19/00* (2006.01)

(52) U.S. Cl.
CPC ..... *B65D 19/38* (2013.01); *B65D 19/0012* (2013.01); *B65D 2203/10* (2013.01); *B65D 2519/00308* (2013.01); *B65D 2519/0099* (2013.01)

(58) Field of Classification Search
None
See application file for complete search history.

(56) References Cited

FOREIGN PATENT DOCUMENTS

| | | | | |
|---|---|---|---|---|
| EP | 3240200 | A1 | | 11/2017 |
| JP | 2002037414 | A | | 2/2002 |
| JP | 2003095270 | A | | 4/2003 |
| JP | 2005170403 | A | | 6/2005 |
| JP | 2008050024 | A | | 3/2008 |
| JP | 2013237455 | A | | 11/2013 |
| JP | 2015224048 | A | * | 12/2015 |
| JP | 2015224048 | A | | 12/2015 |
| JP | 2018047932 | A | | 3/2018 |
| KR | 101207673 | B1 | | 12/2012 |

(Continued)

OTHER PUBLICATIONS

Extended European Search Report for International Application No. PCT/IB2019/057255, International Filing Date:Aug. 28, 2019; dated Oct. 8, 2021, 7 pages.

(Continued)

*Primary Examiner* — Adolf Dsouza
(74) *Attorney, Agent, or Firm* — CANTOR COLBURN LLP

(57) ABSTRACT

A housing unit (1) is provided having a sleeve (10) defining a chamber (11) and a capsule (30) that is arranged to house an electronic device (32) in the capsule (30). The capsule (30) is shaped and configured to be received in the chamber (11). The sleeve (10) and capsule (30) have cooperating securing formations that are arranged to enable the capsule to be releasably secured within the chamber (11). The sleeve (10) is shaped and configured to enable it to fit into a cavity in a load carrier.

15 Claims, 12 Drawing Sheets

(56) References Cited

FOREIGN PATENT DOCUMENTS

| | | | |
|---|---|---|---|
| WO | 2005118383 | A2 | 12/2005 |
| WO | 2006080857 | A1 | 8/2006 |

OTHER PUBLICATIONS

International Search Report and Written Opinion for International Application No. PCT/IB2019/057255; International Filing Date: Aug. 28, 2019; dated Nov. 13, 2019; 7 pages.
Office Action issued in Japanese Application No. 2021-536431 dated May 22, 2023, 5 pages.

* cited by examiner

HOUSING UNIT FOR A LOAD CARRIER

CROSS REFERENCE TO RELATED APPLICATIONS

This application is a National Stage application of PCT/IB2019/057255, filed Aug. 28, 2019, which claims priority from South African provisional patent application number 2018/05723 filed on 28 Aug. 2018, which are incorporated by reference in their entirety herein.

FIELD OF THE INVENTION

This invention relates to a housing unit for a load carrier. It finds particular, although by no means exclusive, use with load carriers such as pallets, crates, boxes and containers.

BACKGROUND TO THE INVENTION

Supply chain management and logistics management is constantly evolving to provide better and more efficient control, monitoring and auditing of goods as they progress through the supply chain. As a result, load carriers are often provided with electronic circuitry to enable the identification and tracking of individual loads as well as the monitoring of the conditions to which the load is subjected.

For example, the electronic circuitry may include a radio-frequency identification (RFID) tag or a near-field communication (NFC) tag to allow a load carrier to be uniquely identified. The electronic circuitry may further include a satellite positioning module, such as a global positioning system module, to allow the electronic circuitry to determine its own location and thus that of the load carrier. Sensors, such as humidity sensors, temperature sensors and accelerometers, may also be included in the electronic circuitry to log and report the conditions to which the load is subjected. Radio frequency communication modules may further be included to enable remote communication with the electronic circuitry and microprocessors to control and interrogate the above-mentioned, and other, components. A source of power, such as a battery, may be provided for energising the electronic circuitry and its associated components.

The electronic circuitry needs to be attached or otherwise secured to the load carrier in a manner that preserves the integrity of the circuitry and resists tampering therewith. High quality load carriers, such as plastic pallets, may have lifespans exceeding 10 years. Maintenance, upgrade, or replacement of the electronic circuitry and firmware executing thereon may be required during the lifespan of the load carrier. Therefore, access to the electronic circuitry may be required from time to time.

The applicant considers there to be room for improvement in this regard.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with a first aspect of this invention there is provided a housing unit comprising a sleeve defining a chamber, and a capsule arranged to house an electronic device therein, the capsule being shaped and configured to be received in the chamber; wherein the sleeve and capsule have cooperating securing formations arranged to enable the capsule to be releasably secured within the chamber, and wherein the sleeve is shaped and configured to enable the sleeve to fit into a cavity in a load carrier.

Further features provide for the securing formations to include a female securing formation and a complementary male securing formation that are configured to be mated to each another; and for one of the male and female securing formations to be associated with the sleeve and for the other to be associated with the capsule.

In one exemplary embodiment, the securing formation is a bayonet mount. In an alternative exemplary embodiment, the male securing formation is a sloped tooth-like protrusion and the female securing formation is a spring-loaded catch having an aperture arranged to catch onto an edge of the tooth-like protrusion when the capsule is received in the chamber. In a yet further alternative exemplary embodiment the securing formation is screw thread.

Further features provide for the sleeve to form a friction fit within the cavity in the load carrier; for the sleeve to include one or more gripping structures arranged to enhance the friction fit; for the gripping structures to include one or more gripping projections extending outwardly therefrom; for the gripping projections to be barbs arranged to resist removal of the sleeve from the cavity; and for the gripping structure to be an elongate gripper plate with gripping projections spaced along the plate.

A still further feature provides for an outer end of the capsule to be flush with an open end of the chamber when removably secured therein.

Further features provide for the outer end of the capsule to have a slot or keyhole defined therein to enable the use of a tool or key to facilitate the removable securing of the capsule in the chamber In one embodiment the slot or keyhole is operable with the use of a tool or key to secure the capsule in the sleeve. In another embodiment, the slot or keyhole is operable with the use of a tool or key to release the capsule from the sleeve.

Further features provide for the housing unit to include a tamper indication mechanism arranged to enable detection of one or both of removal of the capsule from the sleeve and insertion of the capsule into the sleeve.

Further features provide for the tamper indication mechanism to include a tamper-evident locking member arranged to fit into the outer end of the capsule; for the tamper-evident locking member to be configured to seat in the slot defined in the outer end of the capsule; and for the tamper-evident locking member to include a magnet to enable an electronic device held in the capsule to detect the removal of the locking member based on a detected magnetic field as a precursor to the removal of the capsule from the sleeve.

Alternative features provide for the tamper indication mechanism to include a magnet located in the sleeve arranged to enable a sensor housed in the capsule to detect one or both of removal of the capsule from the sleeve and insertion of the capsule into the sleeve based on a detected magnetic field.

Further features provide for the housing unit to include a spring that is interposed between an inner end of the chamber and the capsule when the capsule is secured in the chamber; for the spring to be secured to the inner end of the chamber; and for the spring to be configured to at least partially push the capsule outwardly from the chamber when the securing formation is disengaged.

Further features provide for the load carrier to be selected from the group consisting of a pallet, skid, crate, and intermediate bulk container; and for the cavity of the load carrier to be formed by strengthening ribs in the body of the load carrier.

Still further features provide for the electronic device to be battery powered; for the electronic device to be an electronic monitoring device; for the electronic monitoring device to have a unique identifier; for the electronic monitoring device to be configured to monitor one or more members of the group consisting of ambient temperature, humidity, acceleration, latitude and longitude, elevation, speed, and tamper events; and for the electronic monitoring device to be configured to log monitoring data and/or to report monitoring data to a remote server.

In accordance with a second aspect of this invention there is provided a sleeve for a housing unit as described above.

In accordance with a third aspect of this invention there is provided a capsule for a housing unit as described above.

In accordance with a fourth aspect of this invention there is provided a load carrier incorporating a housing unit as described above.

In accordance with a fifth aspect of this invention there is provided a method of retrofitting a housing unit to a load carrier, the method including:

providing a sleeve defining a chamber, the sleeve being shaped and configured to fit in a cavity in a load carrier;

fitting the sleeve into the cavity in the load carrier;

providing a capsule for holding an electronic device therein, the capsule being shaped and configured to be received in the chamber, the capsule including a securing formation for securing the capsule within the chamber; and securing the capsule in the chamber.

Further features provide for the step of fitting the sleeve into the cavity in the load carrier to be preceded by the step of machining a cavity in the load carrier that is shaped to enable fitting of the sleeve therein.

An embodiment of the invention will now be described, by way of example only, with reference to the accompanying drawings.

DETAILED DESCRIPTION WITH REFERENCE TO THE DRAWINGS

Figure 1:
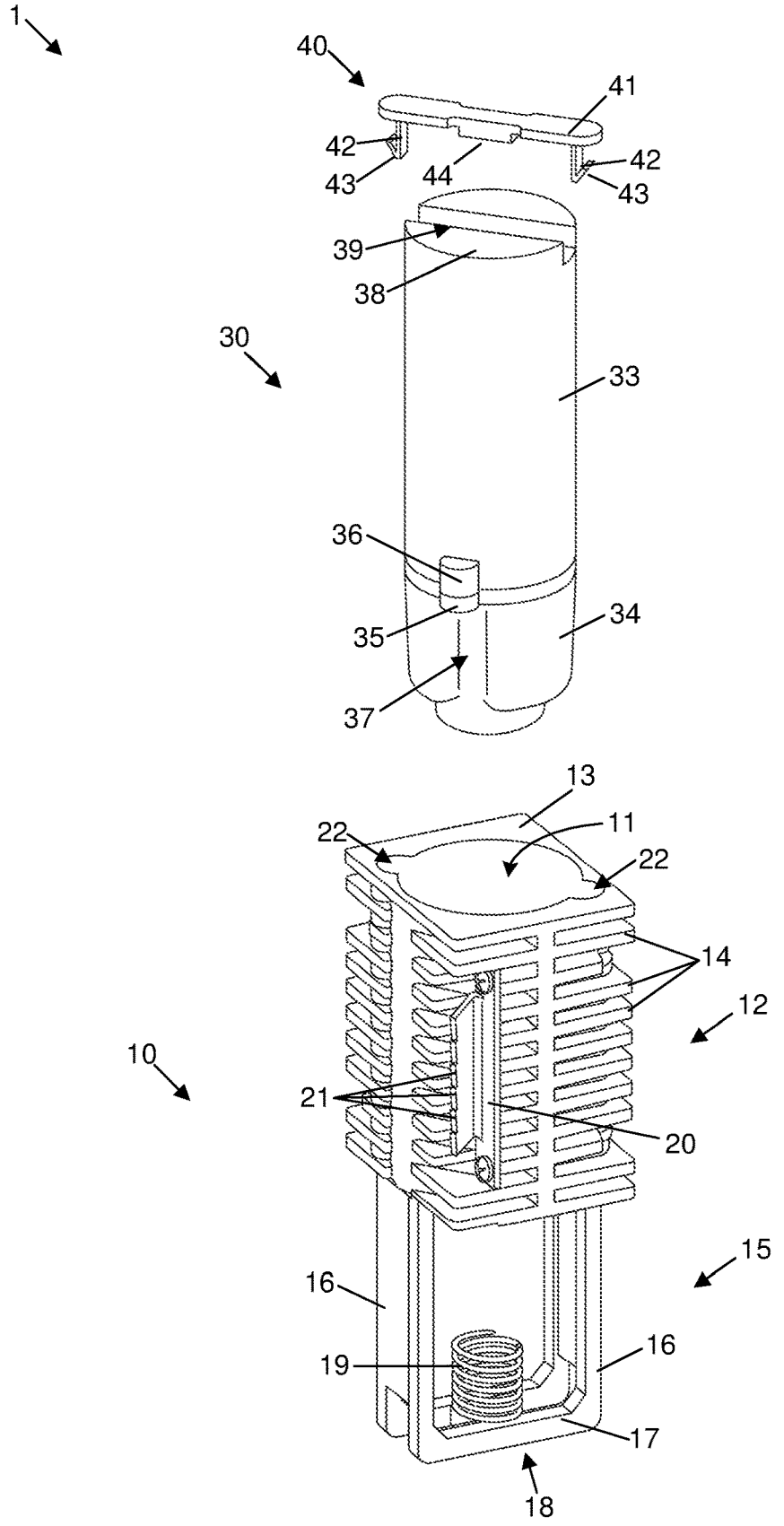
FIG. 1 is an exploded three-dimensional view of a housing unit for a load carrier in accordance with the invention.
Figure 2:
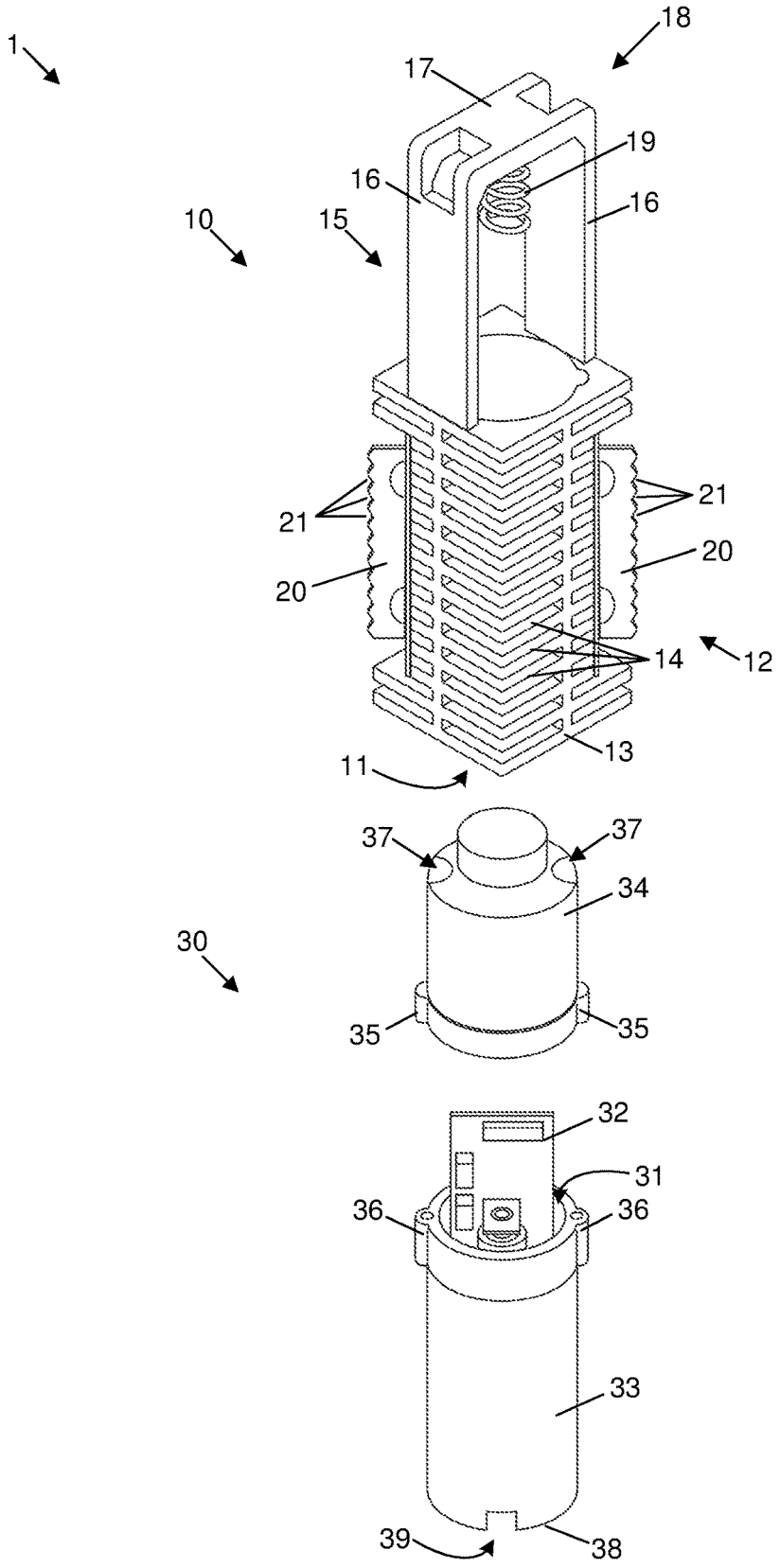
FIG. 2 is a further exploded three-dimensional view of the housing unit of FIG. 1 showing an electronic device held by a capsule of the housing unit.
Figure 3:
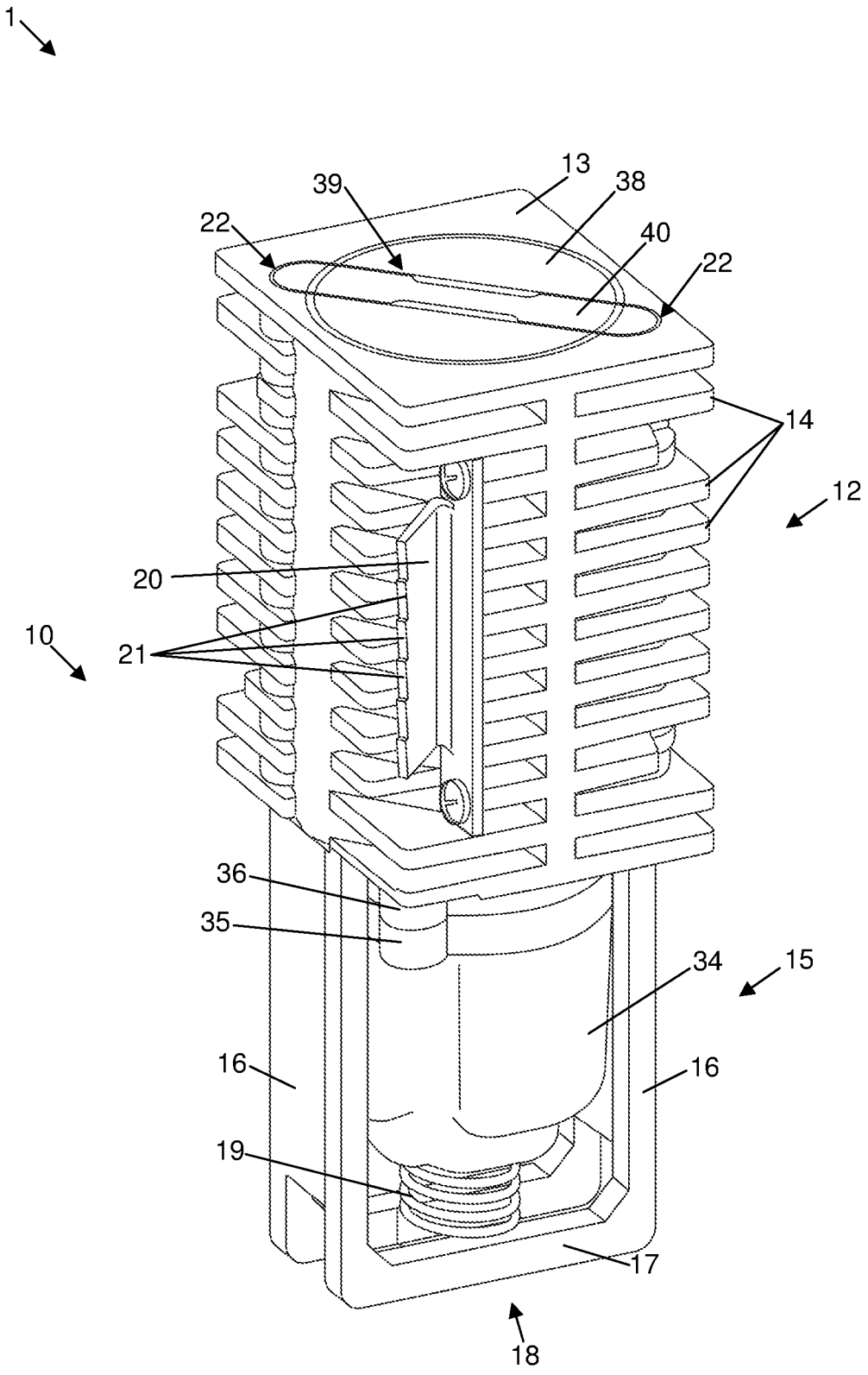
FIG. 3 is a three-dimensional view of the housing unit of FIG. 1 with the capsule secured in a sleeve of the housing unit and with a tamper-evident tab installed in the capsule.
Figure 4:
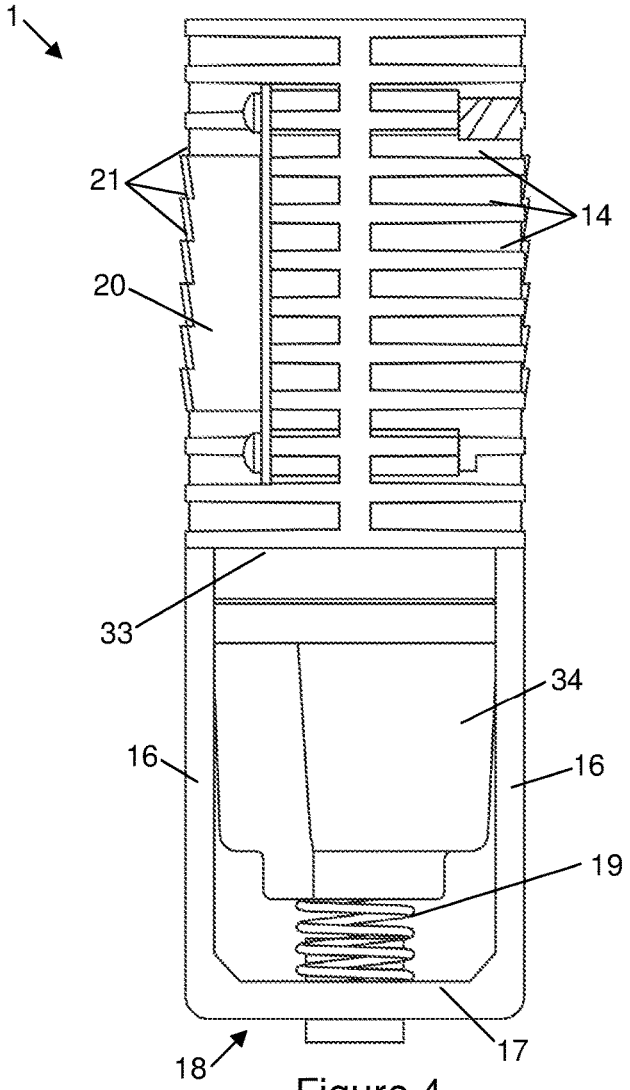
FIG. 4 is a front view of the housing unit in the configuration shown in FIG. 3.
Figure 5:
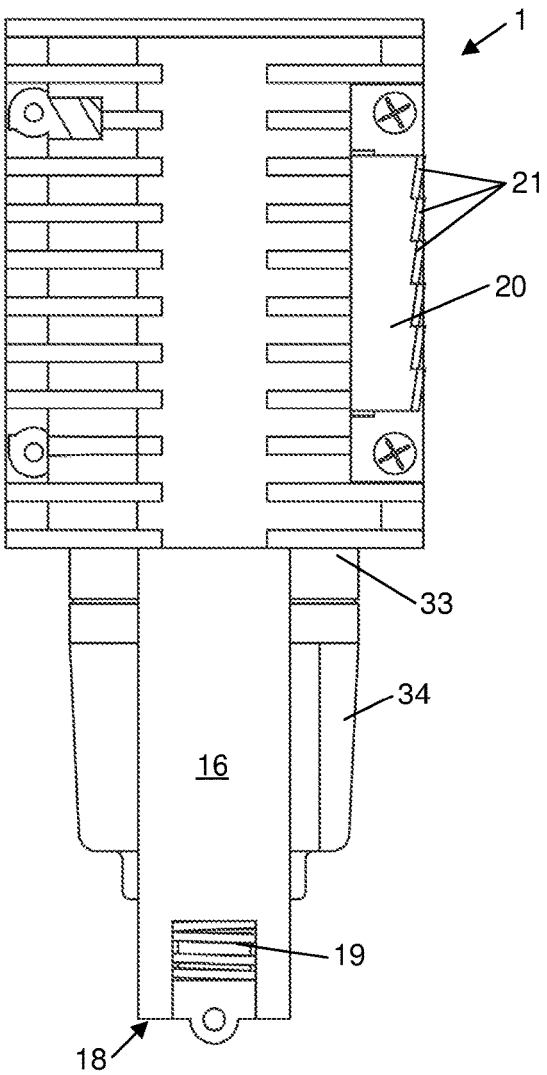
FIG. 5 is a side view of the housing unit in the configuration shown in FIG. 3.
Figure 6:
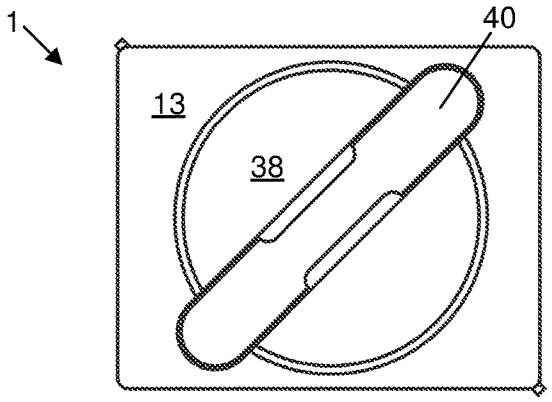
FIG. 6 is a top view of the housing unit in the configuration shown in FIG. 3.
Figure 7:
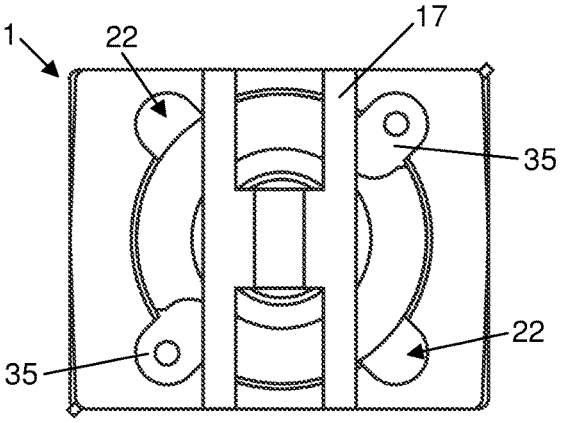
FIG. 7 is a bottom view of the housing unit in the configuration shown in FIG. 3.

Exemplary embodiments of a housing unit for a load carrier are disclosed below. The load carrier may be any load bearing support structure on which transported or shipped goods are carried. It finds particular application with pallets or skids, but may be used with other load carriers, including crates and containers or intermediate bulk containers. It furthermore finds particular application with plastic load carriers, such as moulded plastic pallets and skids.

The housing unit includes a sleeve which, in use, forms the external framework for the housing unit. The sleeve has an internal chamber that is complementarily formed to receive a storage capsule therein and to removably secure the capsule in the chamber. The capsule may be secured in the chamber with a bayonet mount, but any suitable method may be utilised to removably secure the capsule in the chamber, for example with complementary screw thread in the chamber and on the capsule.

The sleeve is arranged and dimensioned to fit into a cavity in the load carrier. Moulded plastic pallets or skids, for example, make use of strengthening ribs to reduce the material and weight of the load carrier while preserving the same load-bearing capacity. The cavity may therefore be provided by the space between these strengthening ribs. In a preferred embodiment the cavity in the load carrier is in one of the support columns or "fins" of the load carrier, typically at a corner thereof.

The capsule may be configured to securely enclose an electronic device therein. The term "electronic device" should be interpreted widely and may include ambient condition sensors, tracking devices, identification devices, data loggers, and the like. To enable radio frequency (RF) communication with the electronic device, the sleeve and the capsule may be manufactured from a polymer material that attenuates the RF signals as little as possible. The capsule may protect the electronic device from the ingress of dust and moisture. The electronic device may be configured to monitor various conditions and will be referred to as an electronic monitoring device in the exemplary embodiment described below.

The sleeve may be arranged to form a friction fit with the walls of the cavity. This may be facilitated by means of a close tolerance between the dimensions of the cavity and the sleeve. The friction fit may be enhanced by, for example, a rough external surface on the sleeve, or with protruding elements that grip into the material surrounding the cavity. However, the external surface of the housing may alternatively, for example, be provided with a resiliently deformable material that compresses when the sleeve is installed into the cavity of the load carrier and thereby provides resistance against the removal of the sleeve from the cavity.

When secured in the chamber of the sleeve, an outer end of the capsule, that is the opposite end to the one inserted into the chamber, may be flush with an open end of the sleeve. The outer end of the capsule may have a slot defined therein. This may enable an operator to use a tool, such as a coin or screwdriver, to secure or remove the capsule since a twisting action may be required, particularly in the case of a bayonet mount or screw fit. This process may also be automated, in which case a robotic arm may insert the capsule into the chamber of the sleeve and secure the capsule therein.

FIGS. 1 to 9 show an embodiment of a housing unit for a load carrier (1) in accordance with the invention. The exploded view of FIG. 1 shows the housing unit (1) having a sleeve (10) and a capsule (30) arranged to be secured within the sleeve (10) in a releasable manner as will be discussed further below. The sleeve (10) has a substantially rectangular cross-sectional profile, which corresponds to the shape of a cavity in a fin of an exemplary load carrier with which the housing unit (1) is to be used.

The sleeve (10) defines a central chamber (11) extending longitudinally into the sleeve (10). The chamber (11) is surrounded by a first, ribbed section (12) immediately extending from an open end (13) of the chamber. The ribbed section (12) has spaced apart, parallel ribs (14) extending radially from the sleeve (10) and defines the generally rectangular cross-sectional shape of the sleeve.

A second, exposed section (15) is provided at the longitudinal end opposite the ribbed section (12). The exposed section (15) mainly comprises two spaced apart and parallel wall sections (16). A transverse member (17) connects the two wall sections (16) and is provided at the end opposite the open end (13) of the chamber. In use, the exposed section (15) is located at the operatively inner, blind end (18) of the chamber (11). The exposed section (15) therefore reveals a portion of the chamber toward the blind end (18) of the chamber (11). A spiral compression spring (19) is secured centrally in the chamber (11) against the transverse member (17) extending toward the open end (13) of the chamber, the functioning of which will be explained below.

The sleeve (10) includes a pair of elongate gripper plates (20) extending radially from opposite sides of the sleeve, each gripper plate defines a row of barbs (21) spaced about an outermost edge of each gripper plate. The gripper plates (20) serve to increase the grip of the friction fit between the sleeve (10) and a load carrier when installed therein.

The housing unit (1) furthermore includes a capsule (30), with a generally cylindrical shape. As shown more clearly on FIG. 2, the capsule (30) has a hollow inner space defining a storage area (31) for holding an electronic device (32) and has two main parts which, for ease of reference, will be referred to as the holder section (33) and the cap section (34). Both sections (33, 34) have diametrically opposing tabs (35, 36) that align when the sections are assembled to form the closed capsule (30). The holder and cap sections (33, 34) are securable to each other by screwing the corresponding tabs (35, 36) on the respective sections together using screws (not shown). The cap section (34) is provided with an elongate recess (37) extending longitudinally in line with each tab (35) in the outside surface of the lower section to enable access to these screws with a screwdriver.

Referring again to FIG. 1, the axially outer surface (38) of the holder section (33) is substantially flat with a diametrically extending slot (39) defined therein. The housing unit (1) further includes a tamper-evident tab (40) having an elongate cross-member (41), arranged to fit within the slot (39) in the holder section (33). The tamper-evident tab (40) further has two resiliently flexible clips (42) provided at each outer end thereof and extending substantially perpendicular from the cross-member (41) at rest. Each clip (42) has an outwardly angled hook (43). The tamper-evident tab (40) furthermore includes a magnet (44) provided on the cross-member (41), substantially centrally between the clips (42), the functionality of which is described further below.

The electronic device (32) contained in the capsule (30) may have a magnetically sensitive component provided thereon that is arranged to detect the presence (or absence) of the magnet (44) on the tamper-evident tab (40). This may allow the electronic device (32) to log an event on local memory and/or send a distress signal to a remote server, indicating that a tamper event has taken place. By including information in the distress signal to uniquely identify the particular load carrier, and optionally its own latitude and longitude position, it may allow an operator to rapidly intervene.

FIGS. 3 to 7 show the capsule (30) secured in the sleeve (10). Seen more clearly in FIGS. 3 and 6, the tamper-evident tab (40) is also in its installed configuration. To install the tamper-evident tab (40), it is located in the slot (39) with the clips (42) extending toward the sleeve and is then pressed into the slot. In the installed configuration, the hooks (43) are arranged to hook onto a catch (not shown) provided in the sleeve (10) to keep the tamper-evident tab (40) in place. Once an electronic monitoring device has been enclosed within the capsule (30), and is ready for commissioning, the capsule may be secured in the sleeve (10) and the tamper-evident tab (40) then installed in the capsule slot (39) as described above. Thereafter, the electronic device (32) may be configured to react to tamper events based on a detected magnetic field intensity. In this manner, the electronic device (32) may detect removal of the capsule (30) from the sleeve (10) by detecting a precursor or intermediate step to its removal, i.e. the removal of the tamper-evident tab (40).

The tabs (35, 36) of the capsule (30) perform a secondary role, in that they also form the male side of the bayonet mount that removably secures the capsule (30) to the sleeve (10). The sleeve (10) has corresponding diametrically opposing cut-outs or slots (22) at the opening of its chamber (11) and along its inner length that form the female part of the bayonet mount. To secure the capsule (30) in the chamber (11) of the sleeve (10), the capsule tabs (35, 36) are aligned with the complementary shaped cut-outs (22) at the opening of the chamber (11) and the capsule (30) is then inserted into the chamber until the inserted end of the capsule abuts the spring (19) at the far end of the sleeve (10). At this point, the capsule (30) will be contained in the chamber (11), but with the outer, slotted end slightly protruding from the sleeve (10).

To fully insert the capsule (30) into the sleeve (10) and to releasably secure the capsule therein, a user must apply axial force on the capsule to overcome the force of the spring (19). While applying this axial force, the user must then twist the capsule (30) to operate the bayonet mount and locate the capsule tabs (35, 36) in the capsule's secured position (see FIG. 7). A tool may be inserted in the slot (39) to assist in this procedure. To remove the capsule (30) from the sleeve (10), the reverse of this procedure is performed. Once the capsule (30) has been twisted to undo the bayonet mount, the force of the spring (19) will push the capsule out of the sleeve (10) slightly, which enables an operator to easily grip the capsule for removal from the sleeve. The operator may be a human operator performing the securing of the capsule (30) in the sleeve (10) manually. However, it is envisaged that assembly and servicing of the housing (1) and the electronic device (32) held in the capsule may be automated. The automation may be carried out by a robotic arm that is configured for this purpose, for example.

Figure 8:
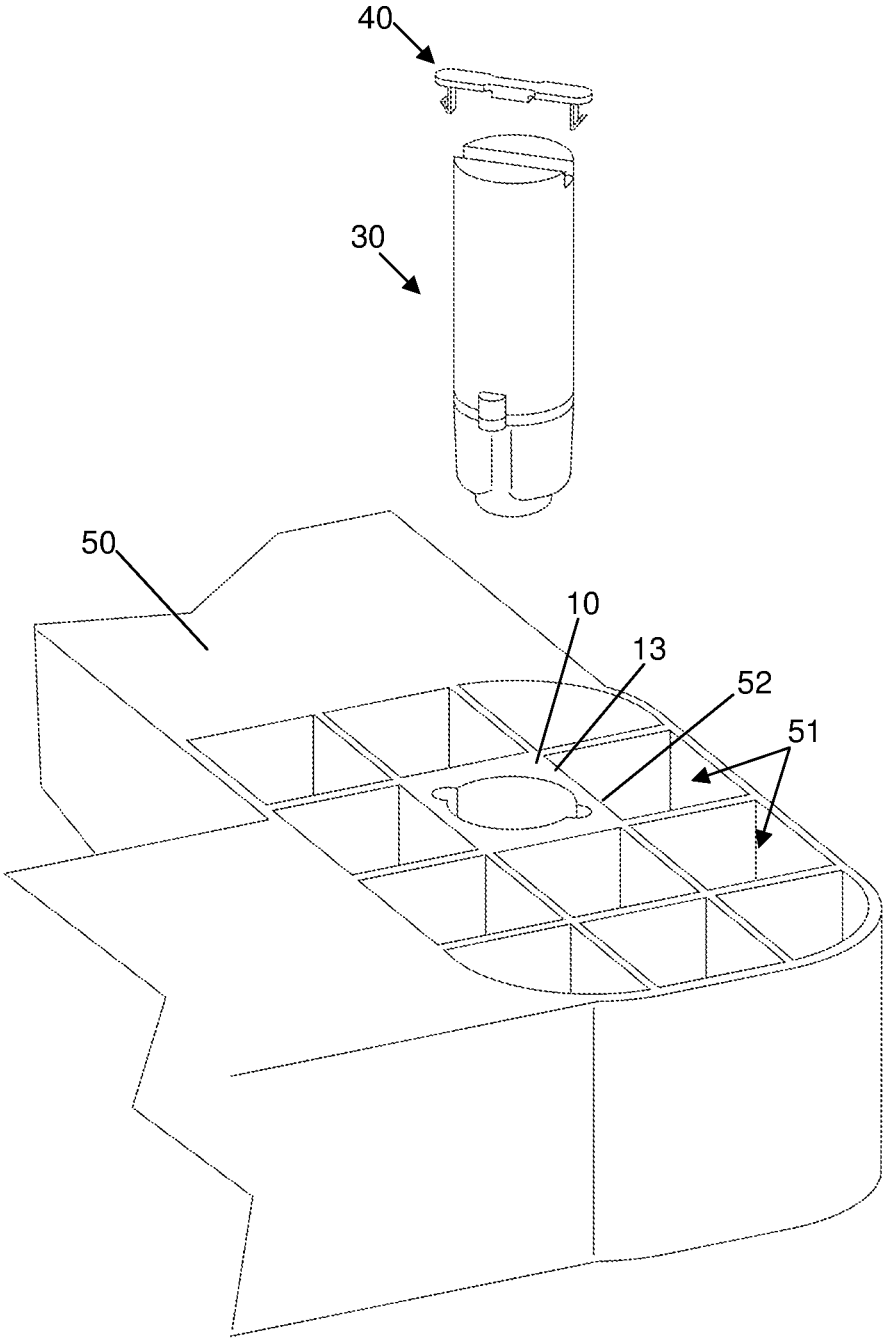
FIG. 8 is a three-dimensional, partially exploded view of the housing unit with the sleeve installed in a load carrier.

FIG. 8 shows the sleeve (10) installed in a load carrier (50). More particularly, it is received in a cavity (51) of the load carrier (50) with the exposed end (15) of the sleeve (10) extending into the relevant cavity (51). The exemplary load carrier shown in FIG. 8 is a plastic pallet. However, the sleeve (10) may be used with any suitable load carrier having cavities defined in the body thereof, regardless of the dimensions of the cavities, with the housing unit (1) and thus the sleeve (10) being adapted accordingly. In use with a load carrier as shown in FIG. 8, the ribbed section (12) is therefore positioned near the mouth (52) of the relevant cavity (51) with the open end (13) of the sleeve (10) being positioned substantially flush with the mouth (52) of the cavity (51).

Figure 9:
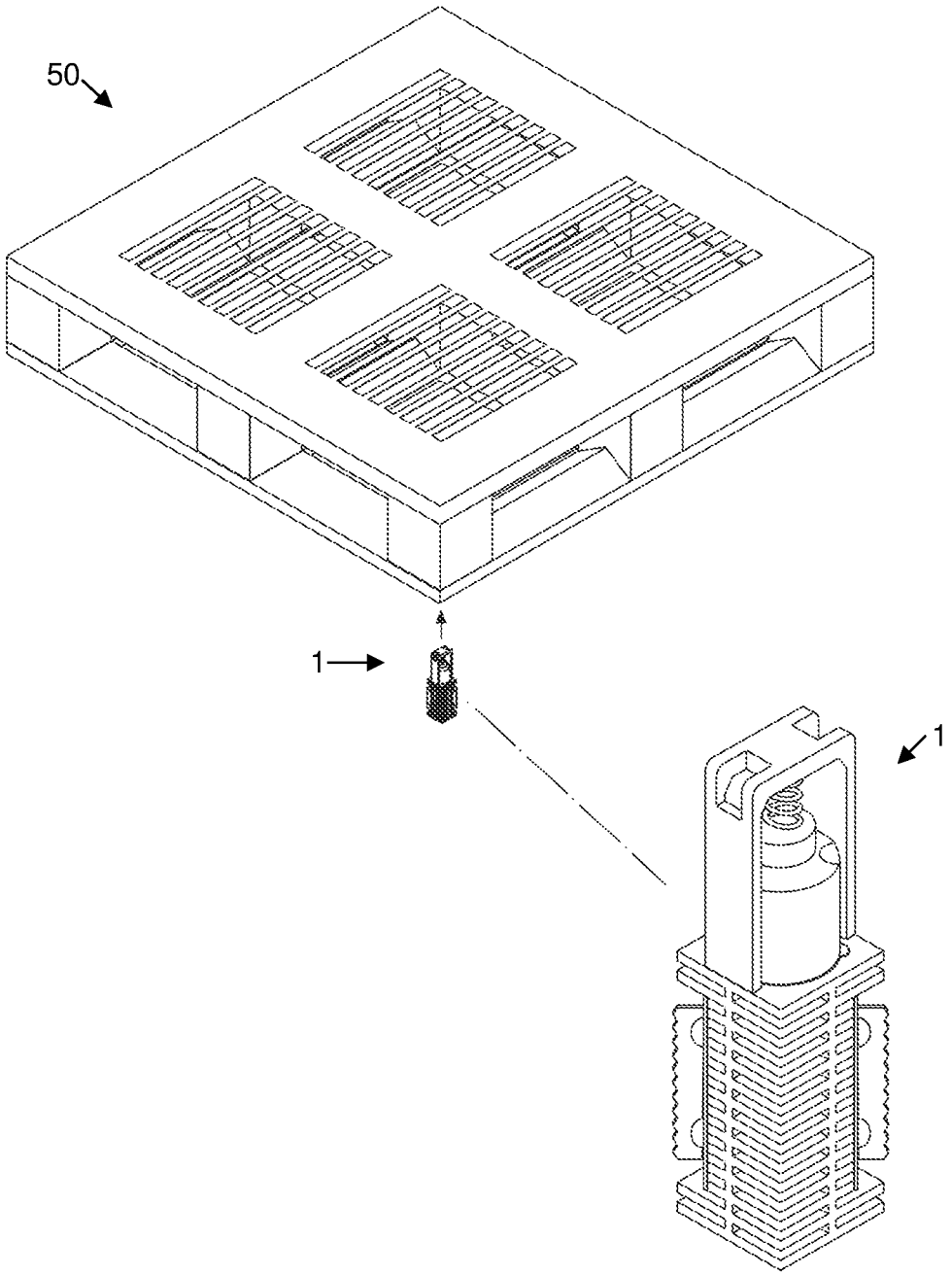
FIG. 9 is a schematic view showing an exemplary installation location of the housing unit on a load carrier.

The sleeve (10) is installed in the cavity (51) by simply press-fitting it into the cavity (see also FIG. 9). This particular embodiment of the housing unit (1) is adapted for the particular load carrier (50) so that the sleeve (10) forms a tight fit in the cavity (51). When the sleeve (10) is installed in the load carrier (50) as shown in FIG. 8, the barbs (21) bite into (or otherwise deform) the inner surface of the cavity (51) in which the sleeve is installed, resisting removal from the cavity. In the present embodiment, the gripper plates (20) extend radially from two opposing corners of the generally squarely profiled sleeve (10). When installed in a load carrier (50), the barbs (21) will therefore extend into, and bite into, the corresponding inner corners of the relevant cavity (51). It will of course be appreciated that an adhesive may further be applied to the outer surface of the sleeve (10) to further increase the grip or bond with the load carrier (50).

FIG. 8 shows the open end (13) of the sleeve (10) to be flush with the mouth (52) of the cavity (51). However, in practice the sleeve (10) may also be installed so as to be somewhat sunken into the cavity (51). This may ensure the stackability of the load carrier (50) on other load carriers for storage purposes, and may furthermore prevent damage and/or detection of the housing unit (1).

While a bayonet-type mount is described in the one embodiment above for removably securing the capsule to the sleeve, it is conceivable that other mechanisms may be used, such as a screw thread arrangement. The bayonet mount arrangement may also be reversed, with projections provided in the chamber and corresponding slots provided in the capsule. The capsule may have quick-access apertures, optionally protected with ingress-protective plugs, to enable data exchange with the electronic monitoring device without requiring removal of the capsule from the sleeve. The embodiment depicted in the figures includes the pair of gripper plates, however it is envisaged that embodiments are possible that only use one gripper plate or where no gripper plates are necessary and the sleeve is simply press-fitted, glued or otherwise secured into the cavity in the load carrier. It will further be appreciated that the magnetically sensitive component provided on the electronic device contained in the capsule may alternatively be any suitable sensor for sensing the presence (or absence) of the tamper-evident tab which may comprise a suitable transmitter for that purpose.

FIGS. 10 to 19 show a further embodiment of a housing unit (100) for a load carrier in accordance with the invention. Referring to the exploded views of FIGS. 10 and 11, the housing unit (100) has a sleeve (110) and a capsule (130) arranged to be secured within the sleeve (110) in a releasable manner as will be discussed further below. The sleeve (110) has a substantially round or circular cross-sectional profile, which is shown more clearly in FIGS. 14 and 15. A particular load carrier in which the housing unit (100) is to be used will therefore require a complementary shaped cross-section to enable the sleeve (110) to fitted therein.

The sleeve (110) has a generally cylindrical overall shape. The sleeve (110) defines a central chamber (111) extending longitudinally into the sleeve (110) and has an open end (113) and an opposite blind end (118). The chamber (111) has longitudinally extending ribs (112) along an outer periphery immediately extending from an open end (113) of the chamber (111).

The sleeve (110) includes a pair of diametrically opposed barb-like gripping structures (120) extending radially outwardly from opposite sides of the sleeve. The gripping structures (120) project from a tensile arm (121) extending longitudinally along an outer periphery of the sleeve and serve to increase the grip of the friction fit between the sleeve (110) and a load carrier when installed therein. When the sleeve (110) is inserted into a cavity in a load carrier, the barb-like gripping structures (120) may press against the sides of the cavity and be urged radially inwardly against a bias of the tensile arms (121), thereby creating a radially outwardly directed force enhancing its grip within the cavity. It is also envisaged that the cavity in the load carrier into which the sleeve (110) is to be installed may have an indentation at a longitudinal position corresponding to that of the gripping structures (120). This may enable the barb-like gripping structures (120) to clip into these indentations when inserted into the cavity of the load carrier, thereby making the sleeve (110) resistant to removal from the load carrier.

Figure 10:
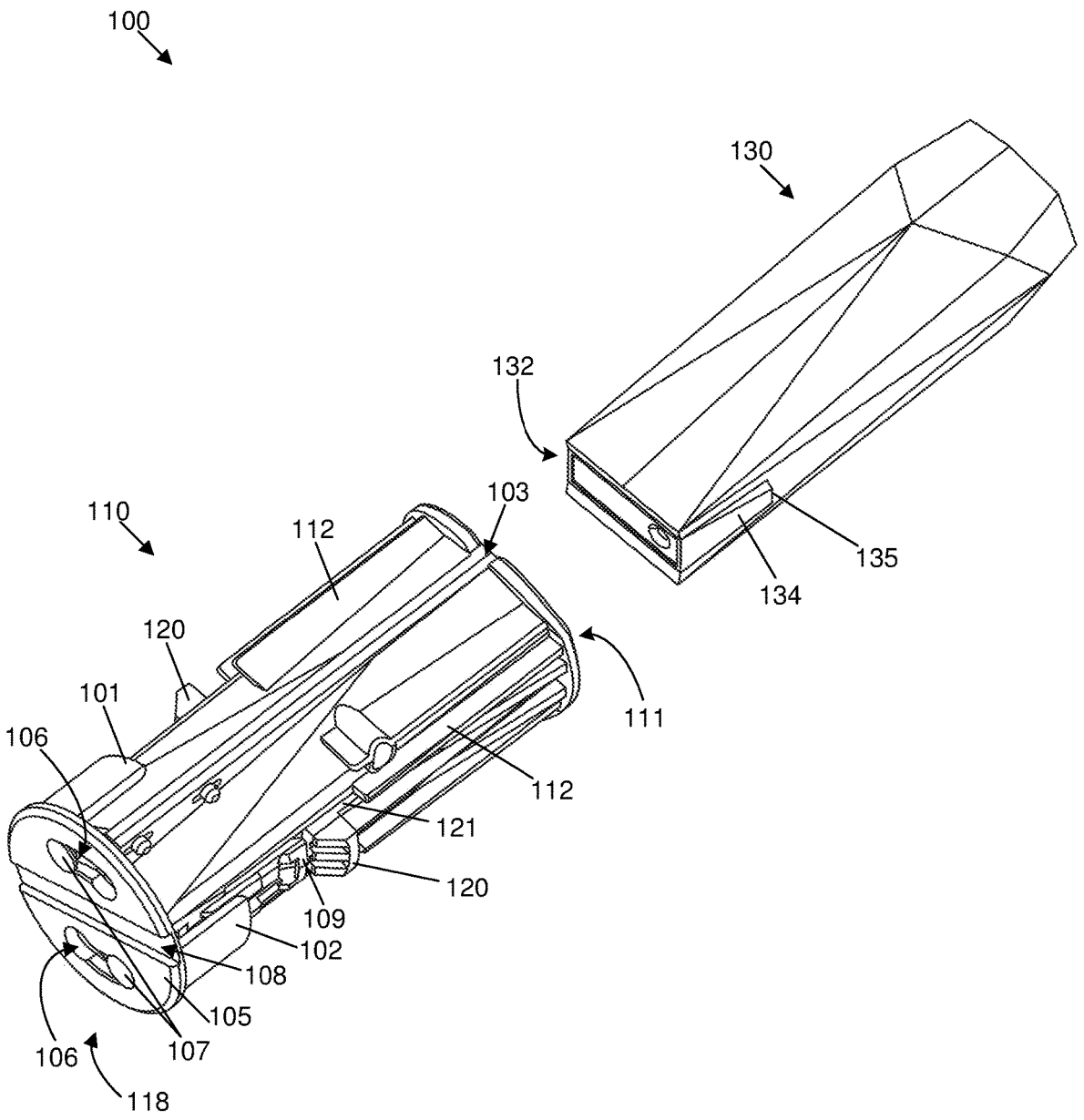
FIG. 10 is a three-dimensional exploded view of a further embodiment of a housing unit.
Figure 11:
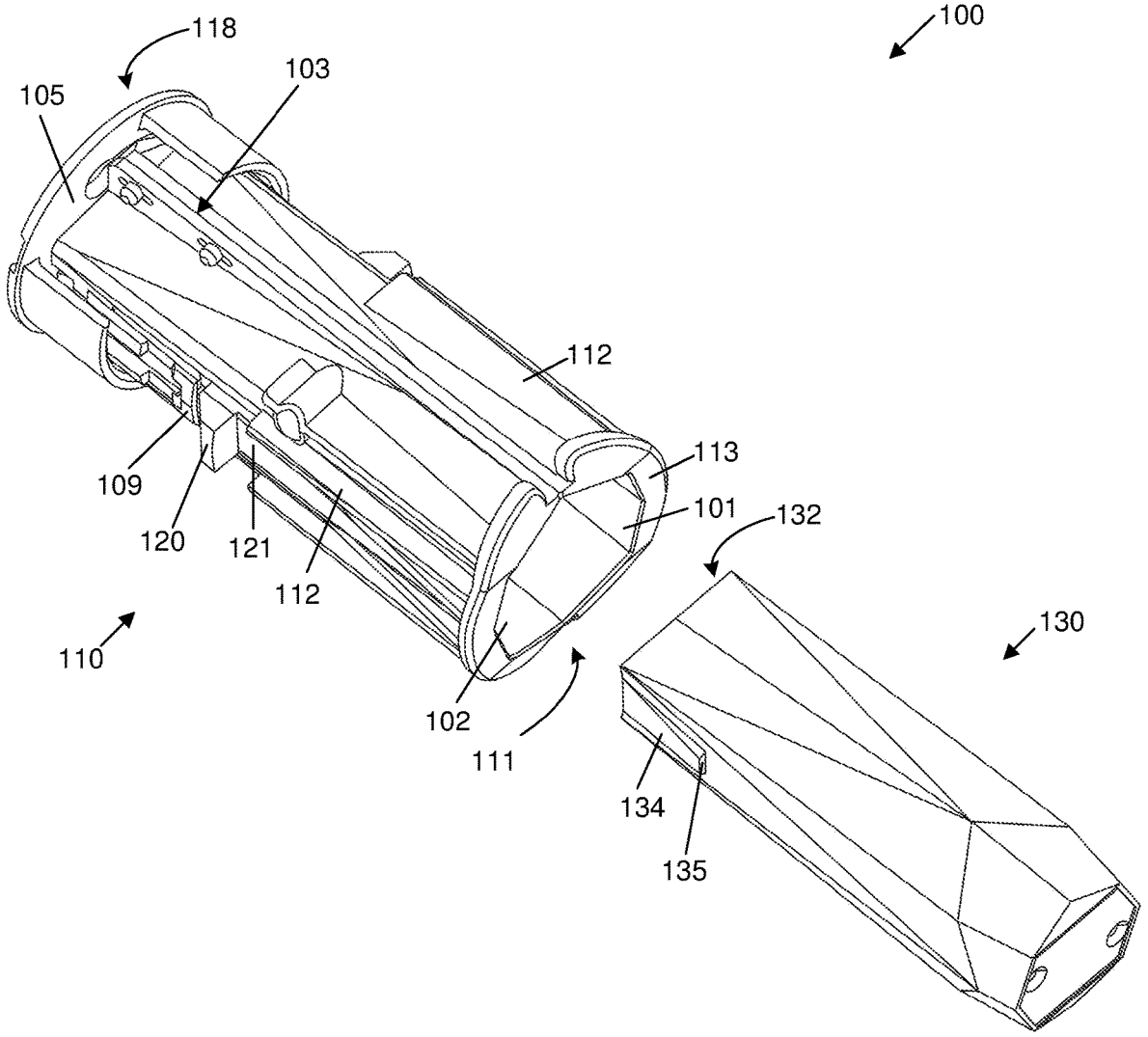
FIG. 11 is an alternate view of three-dimensional exploded view of FIG. 10.
Figure 12:
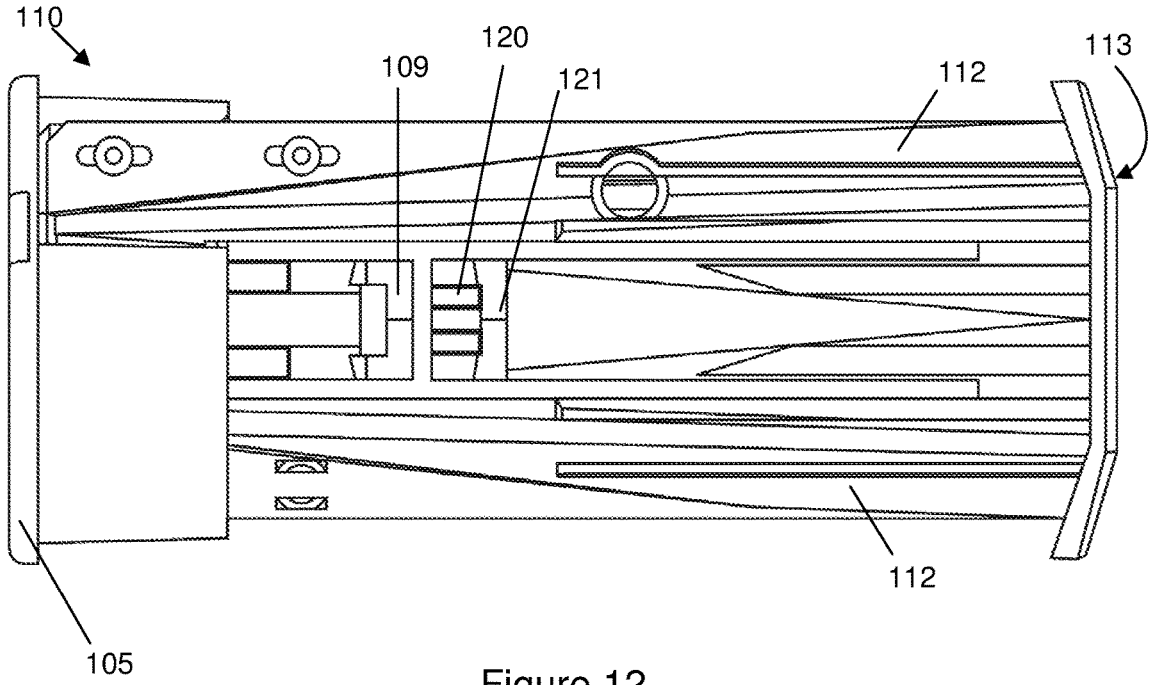
FIG. 12 is a side view of a sleeve of the housing unit of FIG. 10.
Figure 13:
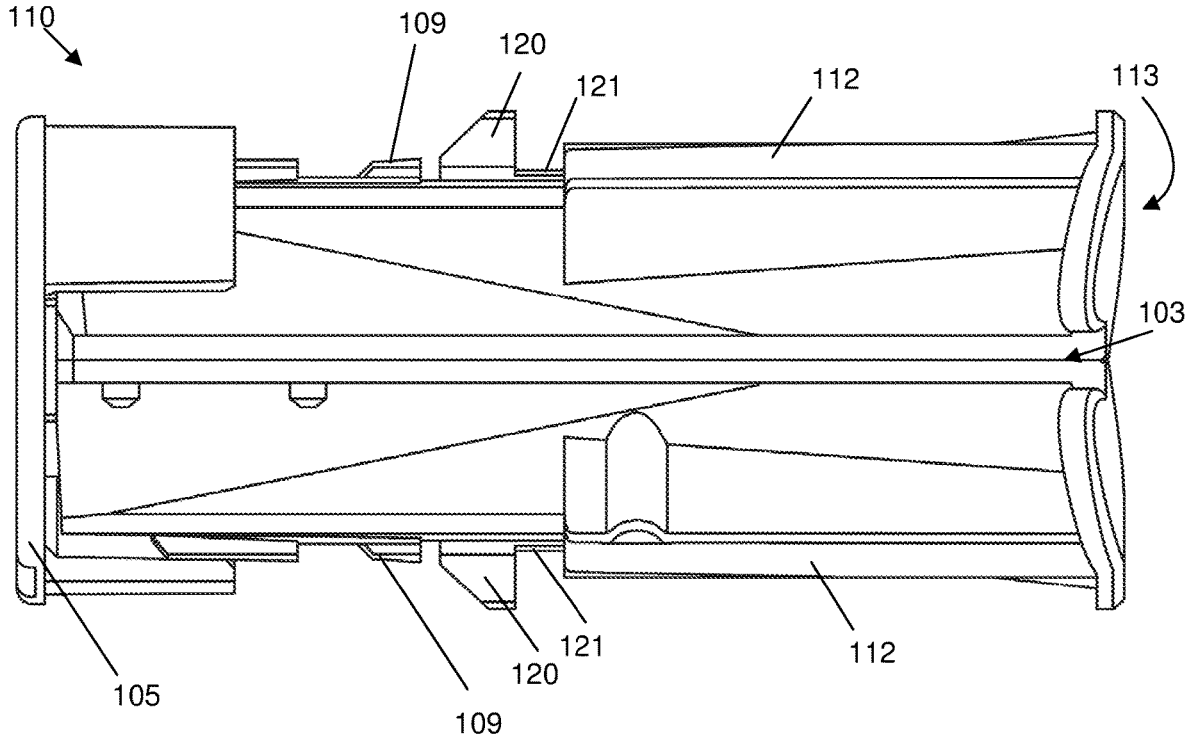
FIG. 13 is an alternate side view of the sleeve of FIG. 12.
Figure 14:
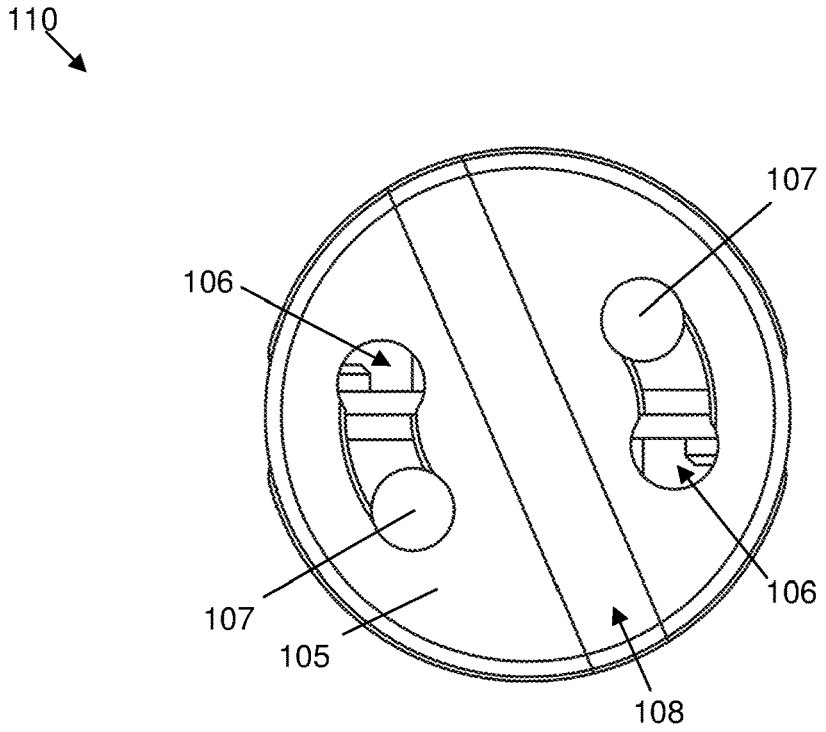
FIG. 14 is an axial view of the sleeve of FIG. 12.
Figure 15:
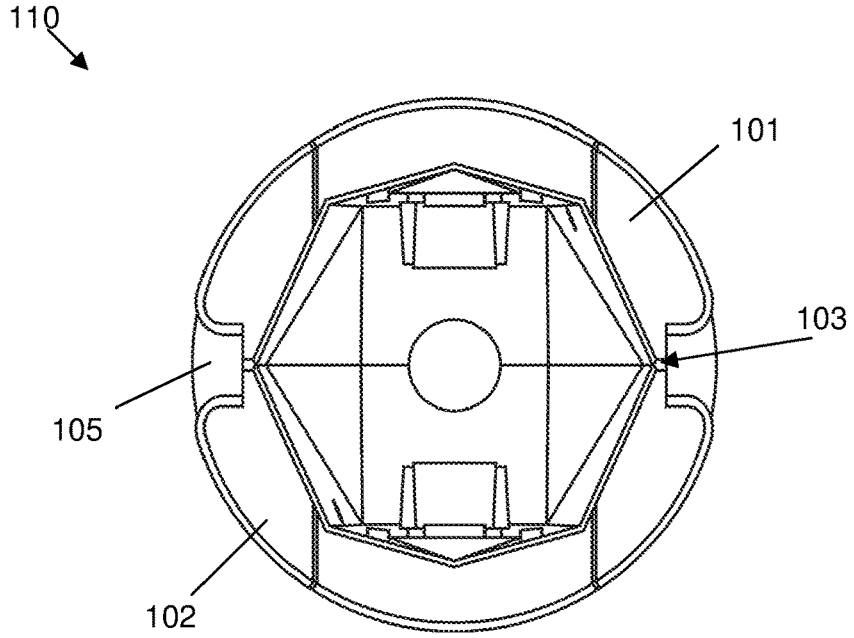
FIG. 15 is an alternate axial view of the sleeve of FIG. 12.
Figure 16:
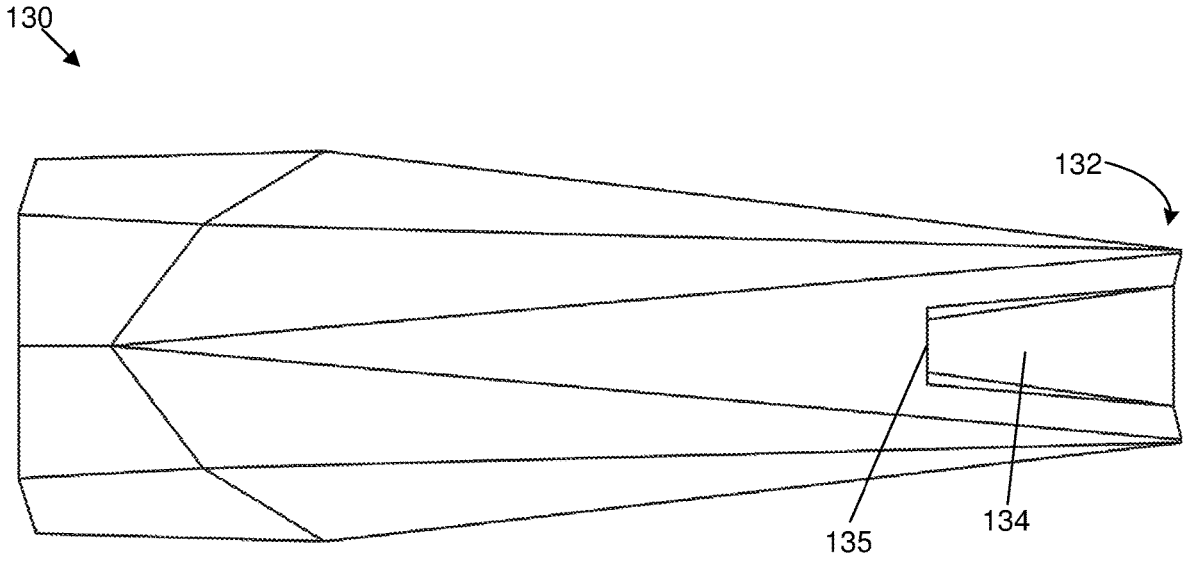
FIG. 16 is a side view of a capsule of the housing unit of FIG. 10.
Figure 17:
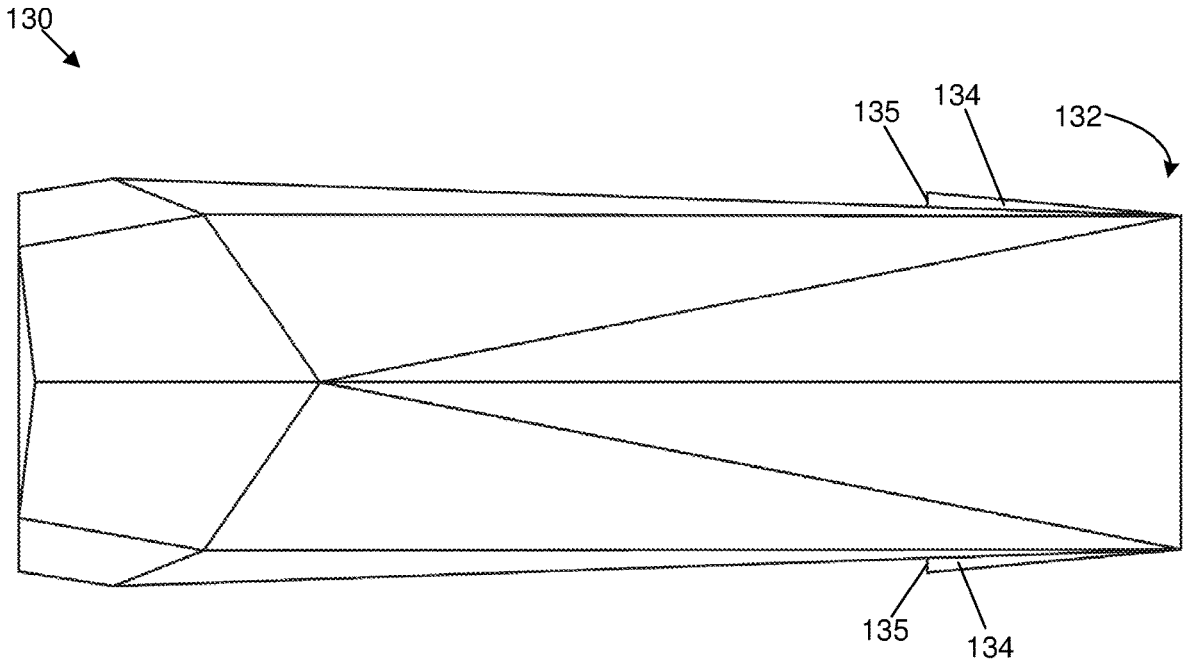
FIG. 17 is an alternate side view of the capsule of FIG. 16.
Figure 18:
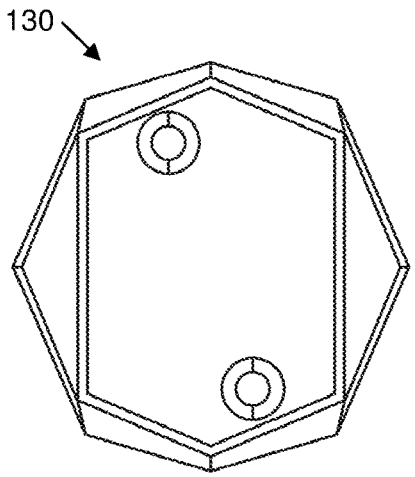
FIG. 18 is an axial view of the capsule of FIG. 16.
Figure 19:
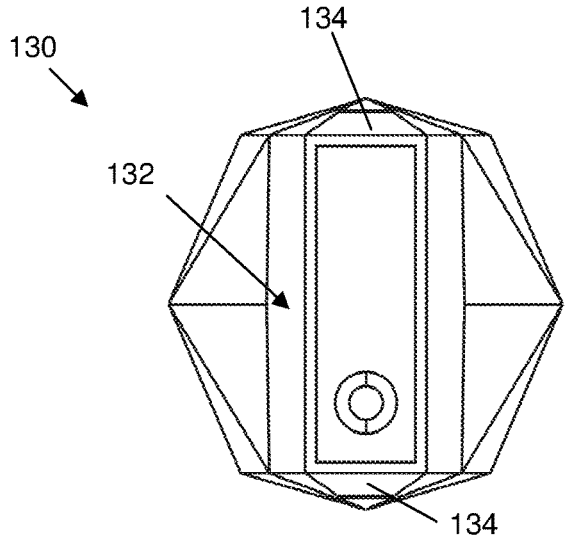
FIG. 19 is an alternate axial view of the capsule of FIG. 16.

The sleeve (110) is constructed from two mirror image halves (101, 102). FIGS. 10 and 11 show a longitudinally extending joint line (103) where the two halves are joined. A substantially disk-shaped endcap (105) facilitates the joining of the two halves (101, 102) and has two diametrically opposed key-hole apertures (106) shaped to receive a corresponding bolt (107) provided on each half (101, 102) of the sleeve (110). To join the two halves (101, 102) together, the head of each bolt (107) is extended through the key-hole apertures (106) in the endcap (105) and the end-cap is rotated so that the head of each bolt locates at the narrow ends of the key-hole apertures. The end-cap (105) furthermore defines a diametrically extending slot (108) in an operatively outer surface thereof.

The housing unit (100) also includes an elongate capsule (130) that is shaped and configured to be received in the sleeve (110). The capsule (130) has substantially flat longitudinal ends, and tapers towards an end (132) that is operatively inserted into the sleeve (110). The capsule (130) has a hollow inner space (not shown) defining a storage area for holding electronic components, batteries, and the like.

A sloped tooth-like protrusion (134) is provided on opposite sides of the capsule (130) near the end (132) that is operatively inserted into the sleeve (110). Each tooth-like protrusion (134) slopes radially outwardly and terminates in a protruding edge (135). This forms the male part of the securing formation that operatively secures the capsule (130) within the sleeve (110).

The sleeve (110) has two diametrically opposed spring-loaded catches (109) having an aperture shaped and configured to clip over the edge (135) of the corresponding tooth-like protrusion (134) of the capsule (130) when the capsule is inserted into the sleeve. This releasably secures the capsule (130) in the sleeve (110). The catches (109) form the female part of the securing formation that operatively secures the capsule (130) within the sleeve (110). To remove the capsule (130) from the sleeve (110) a tool may be utilised to urge the catches a sufficient distance radially outwardly to clear the edge (135) of each tooth-like protrusion (134), allowing the capsule (130) to be extracted.

In the present embodiment, a magnet (not shown) may be located in the sleeve (110). Similarly as the first embodiment, an electronic device (not shown) contained in the capsule (130) may have a magnetically sensitive component provided thereon, such as a hall-effect sensor, that is arranged to detect the presence or absence of the magnet's magnetic field, corresponding to the presence or absence of the capsule (130) in the sleeve (110).

In some embodiments, the housing unit may be configured for a particular load carrier, for a range of load carriers, or at least for a load carrier having a particular cavity size. A load carrier may be supplied with the housing unit pre-installed or at least partially pre-installed in a load carrier.

It will be appreciated that the exemplary embodiments of a housing unit described above is for illustration purposes only and the size, shape and configuration may differ between different embodiments while still remaining within the scope of the invention. For example, a particular load carrier (a pallet, say), may have a round or honeycomb-like structure for structural reinforcement. The housing unit may then have a round or hexagonal profile, as the case may be, to enable it to be received in the cavities of the particular load carrier. The overall length of the housing unit, and thus the sleeve and capsule, may vary to adapt to different load carriers, but also to accommodate different electronic monitoring devices.

Figure 20:
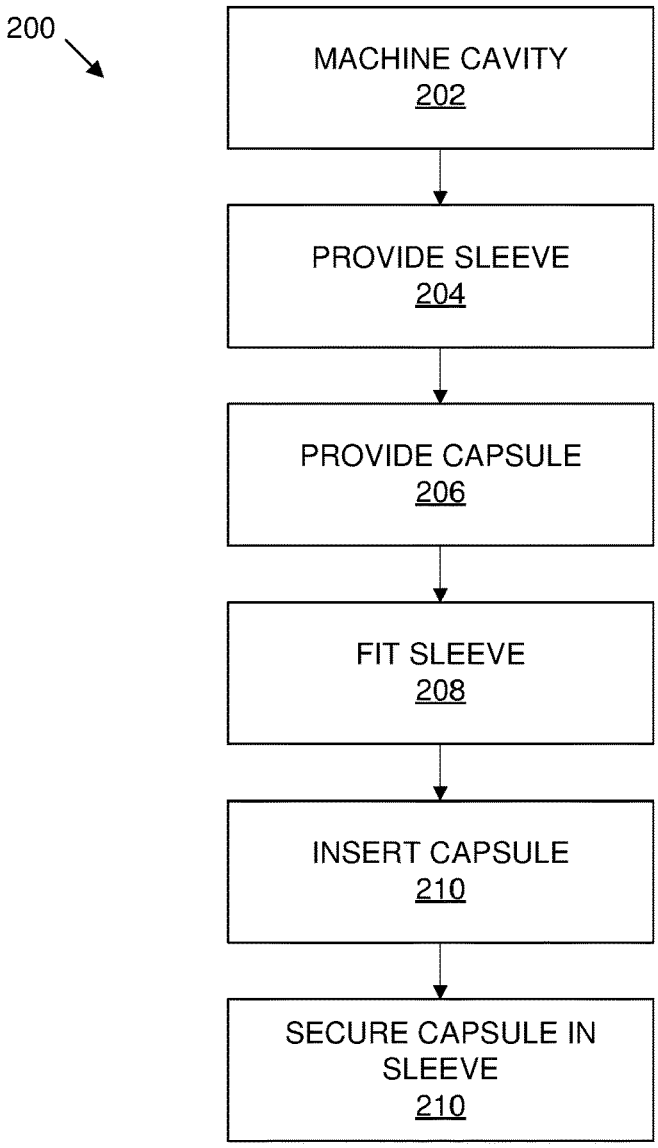
FIG. 20 is a flow diagram of a method for retrofitting a load carrier with a housing unit.

In other embodiments an appropriate cavity may have to be machined into the load carrier, possibly as part of a method of retrofitting the load carrier with a housing unit (1, 100) as described above. FIG. 20 illustrates the steps of a method (200) for retrofitting a load carrier with a housing unit. In a first step, the load carrier may be machined (202) to create a cavity shaped to receive the sleeve (10, 110) therein in a friction fit. It is envisaged that a sleeve with a substantially round cross-section may in some embodiments be more practical since the machining of a round cavity may be easier than a cavity with a square cross-section when retrofitting the load carrier with a housing unit (1, 100).

A sleeve (10, 110) is provided (204) that is fitted (206) in the cavity of the load carrier. A capsule (30, 130) is provided (208) that is shaped and configured to be received in a chamber (11, 111) of the sleeve (10, 110). As a prior step, an electronic device may be commissioned and housed in the capsule (30, 130). The capsule (30, 130) is then inserted (210) into and received by the sleeve (10, 110), and corresponding male and female securing formations of the sleeve and capsule (30, 130), respectively, engage to releasably secure (212) the capsule in the sleeve.

The invention disclosed herein therefore provides a secure, lightweight housing unit for a load carrier and enables electronic monitoring devices to be held therein, whilst still allowing regular authorised access to the electronics for replacement, repair or upgrade, as the case may be. The electronic monitoring device may be protected by the housing unit from liquid or dust ingress, protected from impact damage and may reduce detection of the device by nefarious individuals. Furthermore, in some embodiments no physical modification of may be required if the particular load carrier has pre-existing cavities in which the sleeve may fit. For load carriers that do not have pre-existing cavities, or which are not suited for receiving the sleeve, the relevant load carrier may be retrofitted with a housing unit after machining of a suitable cavity therein.

Throughout the specification unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A housing unit comprising:

a sleeve defining a chamber, and a capsule arranged to house an electronic device therein, the capsule being shaped and configured to be received in the chamber;

wherein the sleeve and capsule have cooperating securing formations arranged to enable the capsule to be releasably secured within the chamber, and wherein the sleeve is shaped and configured to enable it to fit into a cavity in a load carrier, wherein an end of the capsule has a slot or keyhole defined therein to enable the use of a tool or key to facilitate securing of the capsule in the chamber, and wherein the slot or keyhole is operable with the use of a tool or key to either secure the capsule in the sleeve or to release the capsule from the sleeve.

2. A housing unit as claimed in claim 1 wherein the securing formations include a female securing formation and a complementary male securing formation that are configured to be mated to each another, and wherein one of the male and female securing formations is associated with the sleeve and the other associated with the capsule.

3. A housing unit as claimed in claim 2 wherein the male securing formation is a sloped tooth-like protrusion and the female securing formation is a spring-loaded catch having an aperture arranged to catch onto an edge of the tooth-like protrusion when the capsule is received in the chamber.

4. A housing unit as claimed in claim 1 wherein the sleeve forms a friction fit within the cavity in the load carrier, the sleeve including one or more gripping structures arranged to enhance its friction fit in the cavity of the load carrier.

5. A housing unit as claimed in claim 4 wherein the gripping structures include barbs arranged to resist removal of the sleeve from the cavity.

6. A housing unit as claimed in claim 1 wherein an outer end of the capsule is flush with an open end of the chamber when secured therein.

7. A housing unit as claimed in claim 1 further including a tamper indication mechanism arranged to enable detection of one or both of removal of the capsule from the sleeve and insertion of the capsule into the sleeve.

8. A housing unit as claimed in claim 7 wherein the tamper indication mechanism includes a tamper-evident locking member arranged to seat in the slot or keyhole defined in the outer end of the capsule.

9. A housing unit as claimed in claim 8 wherein the tamper-evident locking member includes a magnet to enable an electronic device held in the capsule to detect the removal of the locking member based on a detected magnetic field.

10. A housing unit as claimed in claim 7 wherein the tamper indication mechanism includes a magnet located in the sleeve arranged to enable a sensor housed in the capsule to detect of one or both of the removal of the capsule from the sleeve and the insertion of the capsule into the sleeve based on a detected magnetic field.

11. A housing unit as claimed in claim 1 further including a spring arranged to at least partially push the capsule from the chamber under its bias when the securing formation is disengaged.

12. A sleeve for a housing unit as claimed in claim 1.

13. A capsule for a housing unit as claimed in claim 1.

14. A load carrier incorporating a housing unit as claimed in claim 1.

15. A method of retrofitting a housing unit to a load carrier, the method including:

providing a sleeve defining a chamber, the sleeve being shaped and configured to fit in a cavity in a load carrier;

fitting the sleeve into the cavity in the load carrier;

providing a capsule shaped and configured to be received in the chamber for holding an electronic device in the capsule, the sleeve and capsule have cooperating securing formations arranged to enable the capsule to be releasably secured within the chamber; and securing the capsule in the chamber, wherein the method includes using a tool or key to operate a slot or keyhole defined in an end of the capsule to either secure the capsule in the sleeve or to release the capsule from the sleeve.

* * * * *